US011474454B2

(12) United States Patent
Kadota

(10) Patent No.: US 11,474,454 B2
(45) Date of Patent: Oct. 18, 2022

(54) DEVELOPING DEVICE, IMAGE FORMING APPARATUS, AND DEVELOPMENT CONTROL METHOD

(71) Applicant: KYOCERA Document Solutions Inc., Osaka (JP)

(72) Inventor: Masaki Kadota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/643,723

(22) Filed: Dec. 10, 2021

(65) Prior Publication Data

US 2022/0187738 A1 Jun. 16, 2022

(30) Foreign Application Priority Data

Dec. 14, 2020 (JP) ..... JP2020-206465

(51) Int. Cl.
*G03G 15/08* (2006.01)

(52) U.S. Cl.
CPC ..... *G03G 15/0889* (2013.01)

(58) Field of Classification Search
CPC ..... G03G 15/0822; G03G 15/0844; G03G 15/0877; G03G 15/0887; G03G 15/0889; G03G 15/0891
See application file for complete search history.

(56) References Cited

U.S. PATENT DOCUMENTS

2012/0177412 A1* 7/2012 Watanabe ..... G03G 15/0893 399/256
2018/0329344 A1* 11/2018 Tamaki ..... G03G 15/0877

FOREIGN PATENT DOCUMENTS

JP 2010243766 A 10/2010

* cited by examiner

*Primary Examiner* — Hoang X Ngo
(74) *Attorney, Agent, or Firm* — Alleman Hall Creasman & Tuttle LLP

(57) ABSTRACT

A developing device includes a case, a stirring screw, a discharge port, a restriction portion, and a control portion. The case stores developer. The stirring screw circulates the developer inside the case while stirring the developer. The discharge port is an opening for discharging the developer from the case. The restriction portion is disposed between the stirring screw and the discharge port and restricts the movement of the developer toward the discharge port depending on the drive speed of the stirring screw. The control portion drives the stirring screw such that, during a discharge period other than a development process period in which a development process using the developer is performed, the mean drive speed of the stirring screw per unit time is less than the mean drive speed during the development process period to move the developer toward the discharge port through the restriction portion.

8 Claims, 4 Drawing Sheets

DEVELOPING DEVICE, IMAGE FORMING APPARATUS, AND DEVELOPMENT CONTROL METHOD

INCORPORATION BY REFERENCE

This application is based upon and claims the benefit of priority from the corresponding Japanese Patent Application No. 2020-206465 filed on Dec. 14, 2020, the entire contents of which are incorporated herein by reference.

The present disclosure relates to a developing device, an image forming apparatus, and a development control method.

BACKGROUND

As a related art, there is known an image forming apparatus adopting a trickle development method. The trickle development method is an electrophotographic method using two-component developer including toner and carrier, and, in particular, not only the toner but the developer is supplied in the method. The image forming apparatus includes a developing device that circulates developer by a conveying effect of a stirring screw when the developer is supplied from a supply port into a developer storage case. While the developer is circulated, toner in the developer is supplied to a developing roller and consumed in developing electrostatic latent images on a photoconductor drum, whereas little carrier is consumed. Accordingly, the amount of the developer inside the case increases with the supply of the developer. As the amount of the developer increases, the amount of the developer remaining between a supply screw and a reverse conveying screw increases, and the level of the developer rises. In the end, the developer passes over the reverse conveying screw and is discharged from a discharge port.

In the related art, the rotational speed of the supply screw is changed as the rotational speed of the photoconductor drum decreases during printing on thick paper so that the developer can easily pass over the reverse conveying screw and is discharged promptly. This prevents an increase in the amount of the developer inside the case.

SUMMARY

A developing device according to an aspect of the present disclosure includes a case, a stirring screw, a discharge port, a restriction portion, and a control portion. The case stores developer. The stirring screw circulates the developer inside the case while stirring the developer. The discharge port is an opening for discharging the developer from the case. The restriction portion is disposed between the stirring screw and the discharge port and restricts the movement of the developer toward the discharge port depending on the drive speed of the stirring screw. The control portion drives the stirring screw such that, during a discharge period other than a development process period in which a development process using the developer is performed, the mean drive speed of the stirring screw per unit time is less than the mean drive speed during the development process period to move the developer toward the discharge port through the restriction portion.

An image forming apparatus according to another aspect of the present disclosure includes the developing device and an image forming portion. The image forming portion forms an image using the developer.

A development control method according to another aspect of the present disclosure is used by a developing device including a case, a stirring screw, a discharge port, and a restriction portion. The case stores developer. The stirring screw circulates the developer inside the case while stirring the developer. The discharge port is an opening for discharging the developer from the case. The restriction portion is disposed between the stirring screw and the discharge port and restricts the movement of the developer toward the discharge port depending on the drive speed of the stirring screw. The development control method includes driving the stirring screw such that, during a discharge period other than a development process period in which a development process using the developer is performed, the mean drive speed of the stirring screw per unit time is less than the mean drive speed during the development process period to move the developer toward the discharge port through the restriction portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

Embodiment 1

[1] Overall Configuration of Image Forming Apparatus

First, the overall configuration of an image forming apparatus 10 according to the present embodiment will be described with reference to FIGS. 1 and 2.

Figure 1:
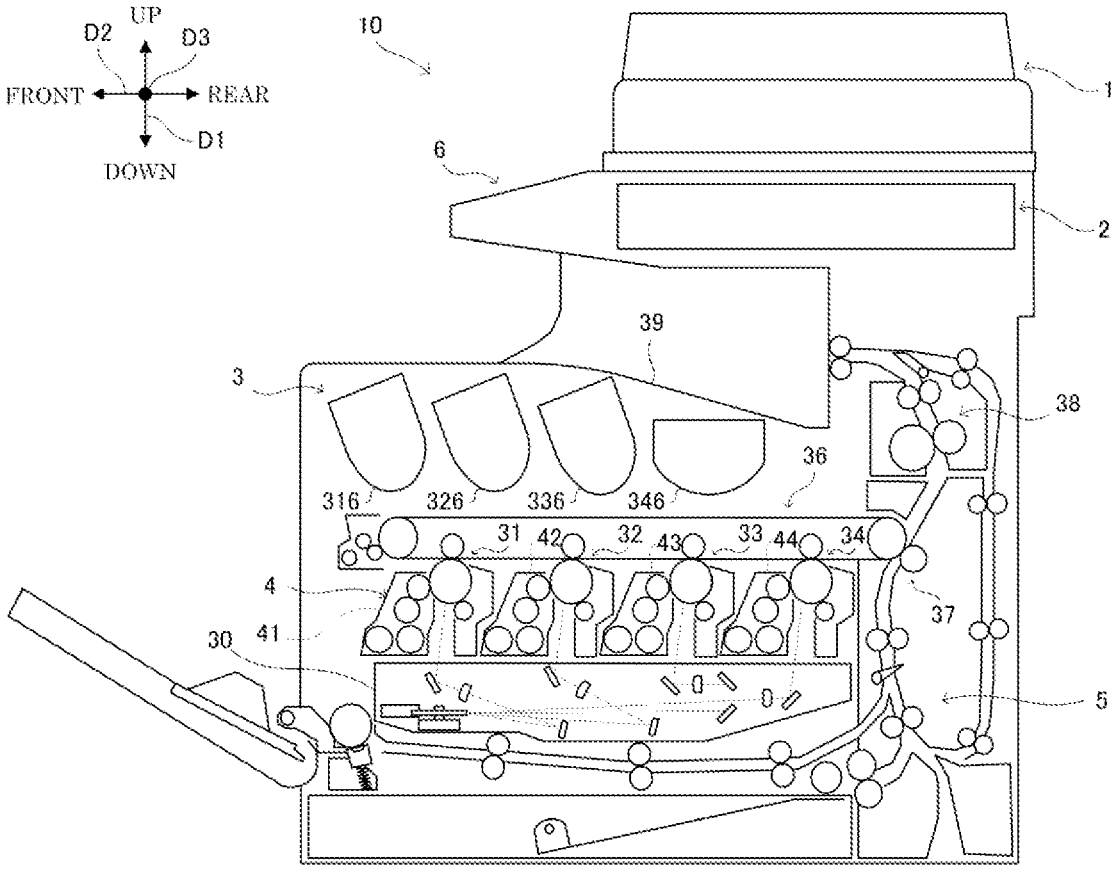
FIG. 1 is a schematic diagram showing the external appearance and the internal configuration of an image forming apparatus according to Embodiment 1.

For purposes of illustration, the vertical direction in a state where the image forming apparatus 10 is installed and ready for use (as shown in FIG. 1) is defined as an up-down direction D1. In addition, a front-rear direction D2 is defined based on the premise that the left face, on the page, of the image forming apparatus 10 shown in FIG. 1 serves as the front (front face). In addition, a left-right direction D3 is defined relative to the front of the image forming apparatus 10 in the installed state.

As an example, the image forming apparatus 10 according to the present embodiment is a multifunction peripheral with multiple functions such as a scan function of reading image data from document sheets, a print function of forming images based on image data, a facsimile function, and a copy function. The image forming apparatus 10 may be any apparatus having the image forming function and includes a printer, a facsimile apparatus, and a copier.

Figure 2:
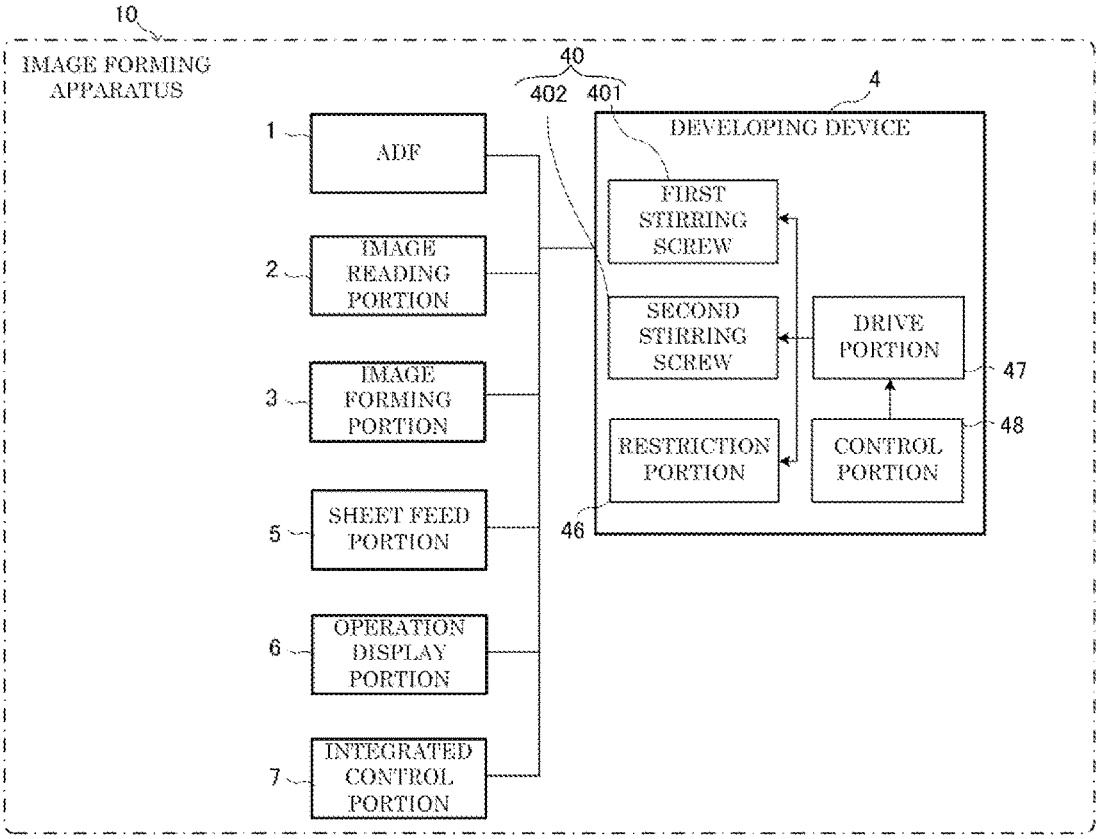
FIG. 2 is a schematic block diagram of the image forming apparatus according to Embodiment 1.

As shown in FIGS. 1 and 2, the image forming apparatus 10 includes an automatic document feeder 1, an image reading portion 2, an image forming portion 3, a developing device 4, a sheet feed portion 5, an operation display portion 6, and an integrated control portion 7. In other words, the developing device 4 according to the present embodiment constitutes the image forming apparatus 10 together with the image forming portion 3 and the like. Hereinafter, the automatic document feeder 1 is referred to as "ADF 1" by its acronym.

The ADF 1 feeds a document sheet having an image to be read by the image reading portion 2. The ADF 1 includes a document sheet set portion, a plurality of conveying rollers, a document sheet holder, and a sheet discharge portion.

The image reading portion 2 reads the image from the document sheet and outputs image data corresponding to the read image. The image reading portion 2 includes a document sheet table, a light source, a plurality of mirrors, an optical lens, and a CCD (Charge Coupled Device).

The image forming portion 3 forms a color or monochrome image on a sheet by an electrophotographic method to implement the print function. The image forming portion 3 forms the image on the sheet based on the image data output from the image reading portion 2. In addition, the image forming portion 3 forms the image on the sheet based on image data input by an information processing apparatus, such as a personal computer, outside the image forming apparatus 10.

Figure 3:
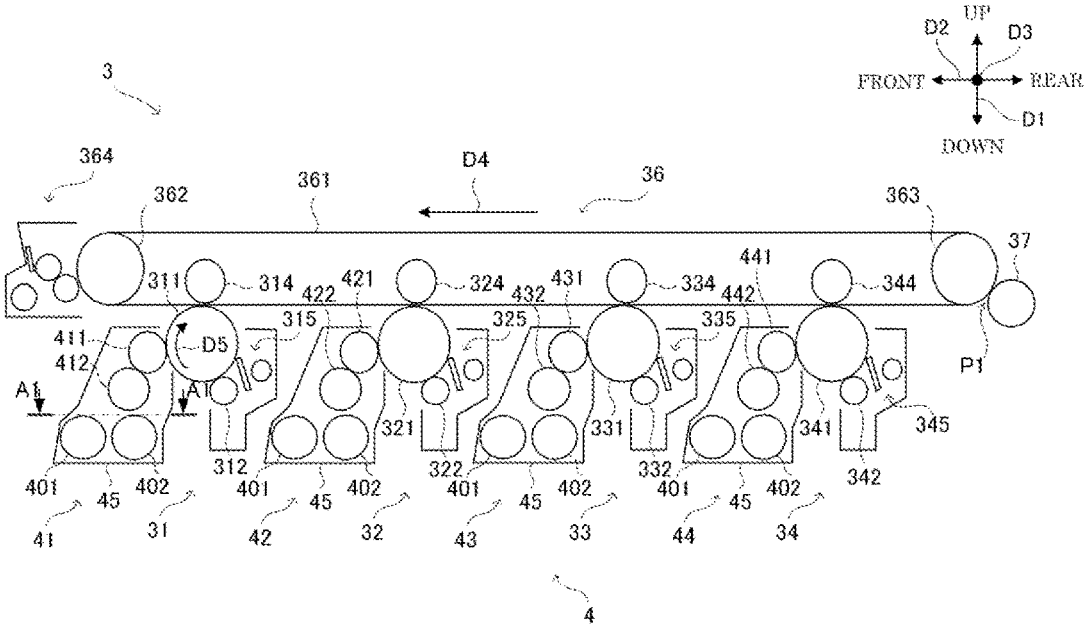
FIG. 3 is a schematic diagram of an image forming portion and a developing device in the image forming apparatus according to Embodiment 1.

The developing device 4 develops electrostatic latent images formed on the surfaces of photoconductor drums 311, 321, 331, and 341 in the image forming portion 3 (see FIG. 3). In particular, in the present embodiment, the developing device 4 performs development using two-component developer including toner and carrier.

The sheet feed portion 5 supplies the sheet to the image forming portion 3. The sheet feed portion 5 includes a sheet feed cassette, a manual feed tray, a sheet conveyance path, and a plurality of conveying rollers. The image forming portion 3 forms the image on the sheet supplied by the sheet feed portion 5.

The operation display portion 6 is a user interface in the image forming apparatus 10. The operation display portion 6 includes a display portion and an operation portion. The display portion includes a liquid crystal display and displays various types of information according to control instructions from the integrated control portion 7. The operation portion includes switches and a touch panel for inputting various types of information to the integrated control portion 7 according to user operations.

The integrated control portion 7 provides integrated control of the image forming apparatus 10. The integrated control portion 7 is mainly composed of a computer system including one or more processors and one or more memories. In the image forming apparatus 10, the one or more processors execute programs to implement the function of the integrated control portion 7. The programs may be stored in the memories in advance, provided through telecommunication lines such as the Internet, or stored and provided in a non-transitory computer-readable storage medium such as a memory card or an optical disk.

The image forming apparatus 10 further includes a storage portion and a communication portion. The storage portion includes one or more nonvolatile memories and stores in advance information including control programs to cause the integrated control portion 7 to perform various processes. The communication portion is an interface that performs data communication between the image forming apparatus 10 and, for example, an external apparatus connected via a communication network such as the Internet and a LAN (Local Area Network).

[2] Configurations of Image Forming Portion and Developing Device

Next, the configurations of the image forming portion 3 and the developing device 4 will be described in more detail with reference to FIGS. 1 and 3.

As shown in FIG. 1, the image forming portion 3 includes a laser scanning unit 30, four image forming units 31 to 34, an intermediate transfer device 36, a secondary transfer roller 37, a fixing device 38, and a sheet discharge tray 39. The developing device 4 includes four developing units 41 to 44 respectively corresponding to the four image forming units 31 to 34.

The image forming unit 31 forms a toner image of yellow (Y). As shown in FIG. 3, the image forming unit 31 includes the photoconductor drum 311, a charging roller 312, a primary transfer roller 314, and a drum cleaning member 315. The image forming unit 31 further includes a toner container 316 (see FIG. 1). The developing unit 41 corresponding to the image forming unit 31 includes a developing roller 411 and a magnet roller 412.

The image forming unit 32 forms a toner image of cyan (C). As shown in FIG. 3, the image forming unit 32 includes the photoconductor drum 321, a charging roller 322, a primary transfer roller 324, and a drum cleaning member 325. The image forming unit 32 further includes a toner container 326 (see FIG. 1). The developing unit 42 corresponding to the image forming unit 32 includes a developing roller 421 and a magnet roller 422.

The image forming unit 33 forms a toner image of magenta (M). As shown in FIG. 3, the image forming unit 33 includes the photoconductor drum 331, a charging roller 332, a primary transfer roller 334, and a drum cleaning member 335. The image forming unit 33 further includes a toner container 336 (see FIG. 1). The developing unit 43 corresponding to the image forming unit 33 includes a developing roller 431 and a magnet roller 432.

The image forming unit 34 forms a toner image of black (Bk). As shown in FIG. 3, the image forming unit 34 includes the photoconductor drum 341, a charging roller 342, a primary transfer roller 344, and a drum cleaning member 345. The image forming unit 34 further includes a toner container 346 (see FIG. 1). The developing unit 44 corresponding to the image forming unit 34 includes a developing roller 441 and a magnet roller 442.

As described above, the plurality (herein four) of image forming units 31 to 34 respectively correspond to the four colors of yellow (Y), cyan (C), magenta (M), and black (Bk), and basically share a common structure. That is, the image forming apparatus 10 according to the present embodiment is an apparatus of a tandem type including a plurality of photoconductors (photoconductor drums) corresponding one-to-one with a plurality of colors. Accordingly, unless otherwise noted, the configurations of the image forming units 32 to 34 are identical to the configuration of the image forming unit 31 described below. Similarly, unless otherwise noted, the configurations of the developing units 42 to 44 are identical to the configuration of the developing unit 41 described below.

An electrostatic latent image is formed on the photoconductor drum 311. The photoconductor drum 311, the charging roller 312, and the drum cleaning member 315 are stored in a unit housing. The photoconductor drum 311 is supported by the unit housing to be rotatable around a rotational axis parallel to the left-right direction D3. The photoconductor drum 311 is subjected to a driving force supplied by, for example, a motor and rotates in a rotation direction D5 shown in FIG. 3.

The charging roller 312 positively charges the surface (outer peripheral surface) of the photoconductor drum 311. Specifically, the charging roller 312 is electrically connected to a power circuit and charges the surface of the photoconductor drum 311 when subjected to high voltage (high-tension voltage) applied by the power circuit. It is noted that the charging roller 312 may charge the surface of the photoconductor drum 311 negatively instead of charging the surface positively.

The surface of the photoconductor drum 311 charged by the charging roller 312 is exposed to a light beam based on the image data emitted by the laser scanning unit 30 (see FIG. 1). This forms an electrostatic latent image on the surface of the photoconductor drum 311. That is, in the present embodiment, the photoconductor drum 311 is an example of an "image-carrying member" on which the electrostatic latent image is formed by the light beam output from the laser scanning unit.

The developing unit 41 develops the electrostatic latent image formed on the surface of the photoconductor drum 311. The developing unit 41 includes a case 45, a first stirring screw 401, and a second stirring screw 402 in addition to the developing roller 411 and the magnet roller 412. The developing roller 411, the magnet roller 412, the first stirring screw 401, and the second stirring screw 402 are supported by the case 45 to be rotatable around the respective rotational axes parallel to the left-right direction D3. In addition, the case 45 stores two-component developer including toner of yellow (Y) and carrier.

The first stirring screw 401 and the second stirring screw 402 stir the developer stored in the case 45 to charge the toner. In the present embodiment, the toner is charged positively. It is noted that the polarity of the toner is not limited to positive and may be negative. The magnet roller 412 draws up the developer stirred by the first stirring screw 401 and the second stirring screw 402 and supplies only the toner in the developer to the surface (outer peripheral surface) of the developing roller 411.

The developing roller 411 develops the electrostatic latent image formed on the photoconductor drum 311 using the charged toner. Specifically, a high-voltage developing bias is applied between the developing roller 411 and the photoconductor drum 311 by the power circuit so that a development field is created. The development field causes the toner with electric charges to move from the developing roller 411 to the photoconductor drum 311. This development process forms a toner image on the surface of the photoconductor drum 311.

The primary transfer roller 314 transfers the toner image formed on the surface of the photoconductor drum 311 by the developing device 4 (developing unit 41) to the outer peripheral surface of an intermediate transfer belt 361 (see FIG. 3). Specifically, a high-voltage transfer bias is applied between the photoconductor drum 311 and the primary transfer roller 314 by the power circuit so that a transfer field is created. The transfer field causes the toner with electric charges to move from the photoconductor drum 311 to the intermediate transfer belt 361. This forms (transfers) a toner image on the outer peripheral surface of the intermediate transfer belt 361.

The drum cleaning member 315 cleans the surface of the photoconductor drum 311 after the toner image is transferred by the primary transfer roller 314. For example, the drum cleaning member 315 includes a blade-like cleaning member and a conveyance member. The cleaning member comes into contact with the surface of the photoconductor drum 311 to remove the toner adhering to the surface. The conveyance member conveys the toner removed by the cleaning member to a toner storage container.

The toner container 316 supplies toner to the case 45 of the developing unit 41. In the image forming unit 31 that forms a toner image of yellow (Y), the toner container 316 supplies toner of yellow (Y).

The toner images of the plurality (herein four) of colors formed by the respective image forming units 31 to 34 are superposed on the outer peripheral surface of the intermediate transfer belt 361 when transferred. This forms a color image (toner image) on the outer peripheral surface of the intermediate transfer belt 361.

As shown in FIG. 3, the intermediate transfer device 36 includes the intermediate transfer belt 361, a tension roller 362, a drive roller 363, a belt cleaning member 364, and a density detection portion. The intermediate transfer device 36 conveys the toner image formed by the image forming units 31 to 34 to a transfer position P1 (see FIG. 3), where transfer of the toner image by the secondary transfer roller 37 is performed, using the intermediate transfer belt 361.

The intermediate transfer belt 361 is an endless belt to which the color toner images on the photoconductor drums 311, 321, 331, and 341 are transferred. As shown in FIG. 3, the intermediate transfer belt 361 is wrapped around the tension roller 362 and the drive roller 363 that are disposed away from each other in the front-rear direction D2 of the image forming apparatus 10. The drive roller 363 rotates under a driving force supplied by a motor. This causes the intermediate transfer belt 361 to rotate in a rotation direction D4 shown in FIG. 3. As the intermediate transfer belt 361 rotates, the toner image transferred to the outer peripheral surface of the intermediate transfer belt 361 is conveyed to the transfer position P1 where transfer of the toner image by the secondary transfer roller 37 is performed. The belt cleaning member 364 cleans the outer peripheral surface of the intermediate transfer belt 361 after the transfer of the toner image is performed at the transfer position P1.

The secondary transfer roller 37 transfers the toner image formed on the outer peripheral surface of the intermediate transfer belt 361 to the sheet supplied by the sheet feed portion 5. As shown in FIG. 3, the secondary transfer roller 37 is disposed at a position facing the drive roller 363, with the intermediate transfer belt 361 interposed therebetween, to be in contact with the outer peripheral surface of the intermediate transfer belt 361. The secondary transfer roller 37 is pressed against the drive roller 363 by a biasing member. The secondary transfer roller 37 is electrically connected to the power circuit and, when subjected to a high voltage applied by the power circuit, transfers the toner image formed on the outer peripheral surface of the intermediate transfer belt 361 to the sheet passing through the transfer position P1 where the secondary transfer roller 37 is in contact with the intermediate transfer belt 361.

The fixing device 38 fuses and fixes the toner image transferred to the sheet by the secondary transfer roller 37 onto the sheet. For example, the fixing device 38 includes a fixing roller and a pressure roller. The fixing roller is disposed to be in contact with the pressure roller and heats and fixes the toner image transferred to the sheet onto the sheet. The pressure roller pressurizes the sheet passing through the contact portion between the pressure roller and the fixing roller.

After the image formation, the sheet is discharged to the sheet discharge tray 39.

[3] Configuration of Developing Device

Figure 4:
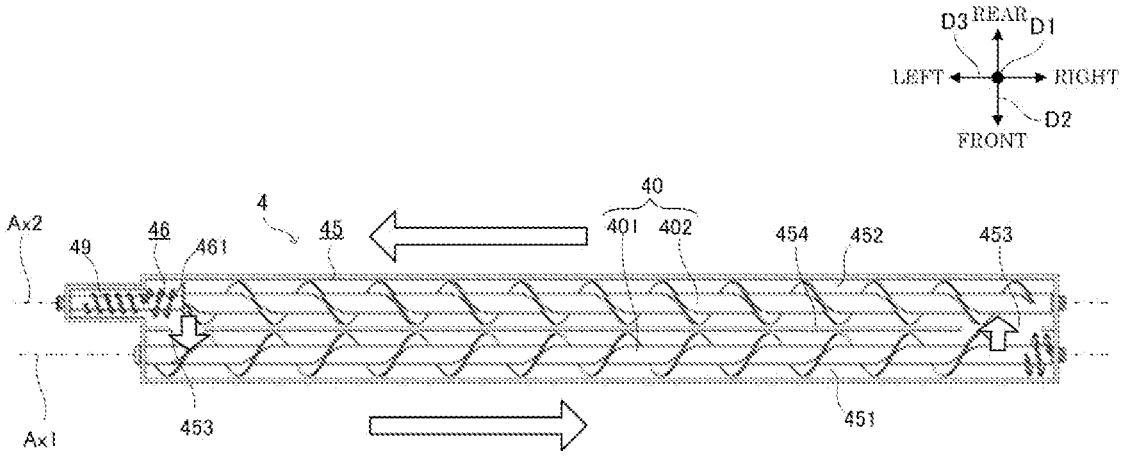
FIG. 4 is a schematic view of a cross-section of the developing device according to Embodiment 1 taken along line A1-A1 in FIG. 3.

Next, the configuration of the developing device 4 will be described in more detail with reference to FIGS. 2, and 4 to 6. In the description below, the configuration of the developing device 4 will be described by taking the developing unit 41 as an example. Unless otherwise noted, the configurations of the developing units 42 to 44 are identical to the configuration of the developing unit 41 described below. FIG. 4 is a schematic view of a cross-section of the developing unit 41 taken along line A1-A1 in FIG. 3 and viewed from above.

In the present embodiment, the developing device 4 (developing unit 41) adopts a trickle development method that discharges surplus of the developer from the case 45 while the developer is being supplied to the case 45. To that end, as shown in FIGS. 2 and 4, the developing device 4 includes stirring screws 40, a restriction portion 46, a drive portion 47, and a control portion 48 in addition to the case 45. In addition, the case 45 has a supply port 456 (see FIG. 5) for supplying the developer to the case 45 and a discharge port 455 (see FIG. 5) for discharging the developer from the case 45. That is, the developing device 4 is provided with the supply port 456 and the discharge port 455 in each developing unit.

The stirring screws 40 circulate the developer inside the case 45 while stirring the developer. In the present embodiment, the stirring screws 40 include the first stirring screw 401 and the second stirring screw 402.

The drive portion 47 produces a driving force for driving the stirring screws 40. The drive portion 47 includes a motor and the like that drive the stirring screws 40 in response to electrical signals from the control portion 48. As an example, in the present embodiment, the single drive portion 47 is provided for the first stirring screw 401 and the second stirring screw 402. That is, the single drive portion 47 drives both the first stirring screw 401 and the second stirring screw 402.

The control portion 48 controls the stirring screws 40. Specifically, the control portion 48 controls the operation of the stirring screws 40 by controlling the drive portion 47. The control portion 48 is mainly composed of a computer system including a processor and a memory. The processor executes a development control program to implement the function of the control portion 48. The development control program may be stored in the memory in advance, provided through telecommunication lines such as the Internet, or stored in and provided by a non-transitory computer-readable storage medium such as a memory card or an optical disk. The processor is composed of an electronic circuit including a semiconductor integrated circuit. Furthermore, the computer system herein includes a microcontroller including a processor and a memory. The control portion 48 may be integral to the integrated control portion 7 that provides integrated control of the image forming apparatus 10.

The restriction portion 46 is disposed between the stirring screws 40 and the discharge port 455. The restriction portion 46 restricts the movement of the developer toward the discharge port 455 depending on the drive speed of the stirring screws 40. That is, the restriction portion 46 dynamically restricts the movement of the developer toward the discharge port 455 depending on the drive speed of the stirring screws 40, and the developer is discharged from the discharge port 455 while the movement of the developer is not restricted by the restriction portion 46.

As a related art, there is known a technique for changing the rotational speed of a supply screw as the rotational speed of a photoconductor drum decreases during printing on thick paper so that the developer can easily pass over a reverse conveying screw and is discharged promptly. This prevents an increase in the amount of the developer inside a case.

According to the method of the related art, however, the rotational speed of the stirring (supply) screw needs to be changed as necessary to stabilize the amount of the developer inside the case during an image formation process (printing). This causes the control to be complicated. In addition, changing the rotational speed of the stirring (supply) screw during image formation changes the development characteristics.

By contrast, the developing device 4 according to the present embodiment can stabilize the amount of the developer inside the case 45 with easier control using the configuration described below.

That is, the developing device 4 according to the present embodiment includes the case 45, the stirring screws 40, the discharge port 455, the restriction portion 46, and the control portion 48. During a discharge period other than a development process period in which a development process using the developer is performed, the control portion 48 drives the stirring screws 40 such that the mean drive speed of the stirring screws 40 per unit time is less than that during the development process period. With this, the control portion 48 moves the developer toward the discharge port 455 through the restriction portion 46.

According to this configuration, during the discharge period other than the development process period in which the development process using the developer is performed for image formation, the control portion 48 drives the stirring screws 40 at a mean drive speed less than that during the development process period to discharge the developer from the discharge port 455. That is, the developing device 4 discharges the developer from the case 45 during idle time in which the image forming apparatus 10 is not used for image formation. Accordingly, the control over the stirring screws 40 can be specific to the discharge of the developing device and relatively simple. In addition, the developing device 4 uses the fact that the movement of the developer is not restricted by the restriction portion 46 when the mean drive speed of the stirring screws 40 is low. Accordingly, the drive portion 47 and the like do not need to be composed of high-quality parts to, for example, endure high-speed drive.

The concrete configuration of the developing device 4 according to the present embodiment will now be described.

In the present embodiment, as shown in FIG. 4, the case 45 includes a first conveyance chamber 451, a second conveyance chamber 452, and connection paths 453. The first conveyance chamber 451 and the second conveyance chamber 452 are disposed in parallel and extend in a predetermined direction (left-right direction D3 in the present embodiment). The connection paths 453 are located at both ends of the conveyance chambers in the predetermined direction and connect the interior spaces of the first conveyance chamber 451 and the second conveyance chamber 452. That is, one of the connection paths 453 connects the left ends of the first conveyance chamber 451 and the second conveyance chamber 452, and the other connection path 453 connects the right ends of the first conveyance chamber 451 and the second conveyance chamber 452. Specifically, the case 45 includes a partition wall 454, and the partition wall 454 partitions the interior space of the case 45 in a direction (front-rear direction D2 in the present embodiment) orthogonal to the predetermined direction into the interior spaces of the first conveyance chamber 451 and the second conveyance chamber 452. The partition wall 454 has openings serving as the connection paths 453 at both ends in the predetermined direction. This allows the interior spaces of the first conveyance chamber 451 and the second conveyance chamber 452 disposed in the direction (front-rear direction D2) orthogonal to the predetermined direction to be continuous at both ends in the predetermined direction through the connection paths 453.

Thus, a flow path having a loop (annular) shape when viewed in plan is formed inside the case 45, and the developer is stored to be circulatable through the loop-shaped flow path. That is, the developer can circulate inside the case 45 by moving from the interior of the first conveyance chamber 451 to the interior of the second conveyance chamber 452 through one of the connection paths 453 and moving from the interior of the second conveyance chamber 452 to the interior of the first conveyance chamber 451 through the other connection path 453. As an example, in the present embodiment, the developer circulates inside the case 45 counterclockwise as indicated by outline arrows in FIG. 4.

The stirring screws 40 include the first stirring screw 401 and the second stirring screw 402. The first stirring screw 401 rotates around a first rotational axis Ax1 parallel to the predetermined direction (left-right direction D3 in the present embodiment). The first stirring screw 401 conveys the developer in the predetermined direction to a first side inside the first conveyance chamber 451 while stirring the developer. The second stirring screw 402 rotates around a second rotational axis Ax2 parallel to the predetermined direction. The second stirring screw 402 conveys the developer oppositely in the predetermined direction to a second side inside the second conveyance chamber 452 while stirring the developer. Here, the first rotational axis Ax1 and the second rotational axis Ax2 are virtual axes without entities and serve as the central axes of rotation.

Specifically, the first stirring screw 401 is rotatably disposed inside the first conveyance chamber 451. As the first stirring screw 401 rotates, the developer moves to the first side (right side in the present embodiment) in the predetermined direction while being stirred inside the first conveyance chamber 451. Upon reaching a first end (right end in the present embodiment) in the predetermined direction inside the first conveyance chamber 451, the developer moves to the second conveyance chamber 452 through the corresponding connection path 453. In addition, the second stirring screw 402 is rotatably disposed inside the second conveyance chamber 452. As the second stirring screw 402 rotates, the developer moves to the second side (left side in the present embodiment) oppositely in the predetermined direction while being stirred inside the second conveyance chamber 452. Upon reaching a second end (left end in the present embodiment) in the predetermined direction inside the second conveyance chamber 452, the developer moves to the first conveyance chamber 451 through the corresponding connection path 453. Accordingly, in the present embodiment, the left side and the right side in FIG. 4 are the upstream side and the downstream side, respectively, for the first conveyance chamber 451, and the right side and the left side in FIG. 4 are the upstream side and the downstream side, respectively, for the second conveyance chamber 452.

Figure 5:
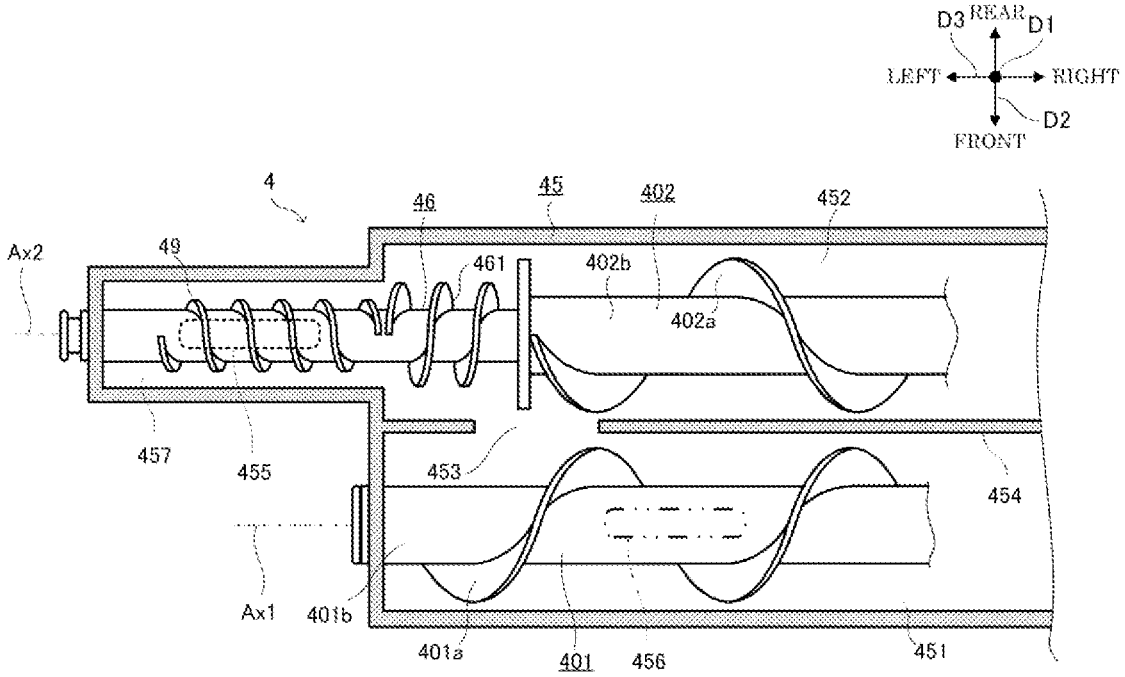
FIG. 5 is a partial enlarged view of the developing device according to Embodiment 1 shown in FIG. 4.

More specifically, as shown in FIG. 5, the first stirring screw 401 includes a rotating shaft 401*b* and a first helical blade 401*a* integral to the rotating shaft 401*b* and helically formed at a certain pitch in the direction of the first rotational axis Ax1 (left-right direction D3). The first helical blade 401*a* extends to both longitudinal ends of the first conveyance chamber 451 and faces both the upstream and downstream connection paths 453. The rotating shaft 401*b* is supported to be rotatable relative to the case 45. The central axis of the rotating shaft 401*b* corresponds to the first rotational axis Ax1.

The second stirring screw 402 includes a rotating shaft 402*b* and a second helical blade 402*a* integral to the rotating shaft 402*b* and helically formed at a certain pitch in the direction of the second rotational axis Ax2 (left-right direction D3). The second helical blade 402*a* has the same pitch as the first helical blade 401*a* and helically runs in a direction opposite the direction of the first helical blade 401*a* (in reversed phase). The second helical blade 402*a* has a length more than or equal to the axial length of the magnet roller 412 and faces at least the connection path 453 upstream in the longitudinal direction in the second conveyance chamber 452. The rotating shaft 402*b* is supported to be rotatable relative to the case 45. The rotating shaft 402*b* is disposed parallel to the rotating shaft 401*b* and has the second rotational axis Ax2 as its central axis.

The rotating shaft 402*b* is further provided with a reverse screw 461 and a discharge blade 49 in addition to the second helical blade 402*a*. As an example, in the present embodiment, the reverse screw 461, the discharge blade 49, and the second helical blade 402*a* are formed from synthetic resin and are integral to the rotating shaft 402*b*.

The supply port 456 is an opening for supplying new toner and carrier into the case 45 from a developer supply case disposed above the case 45 and is located at the upstream end of the first conveyance chamber 451. In FIG. 5, the position of the supply port 456 when viewed in plan is indicated by imaginary lines (long dashed double-short dashed lines).

The discharge port 455 is an opening for discharging excess developer, that is, the surplus of the developer inside the first conveyance chamber 451 and the second conveyance chamber 452 caused by the supply of the developer, to the outside of the case 45. In the present embodiment, as shown in FIG. 5, the discharge port 455 is created in a discharge chamber 457 (see FIG. 5) disposed on the downstream side of the second conveyance chamber 452 in the case 45 and on the extension of the second rotational axis Ax2. That is, the discharge port 455 is located downstream of the second conveyance chamber 452 in the direction along which the developer is conveyed.

Furthermore, the discharge blade 49 integral to the rotating shaft 402*b* is disposed inside the discharge chamber 457. The discharge blade 49 is a helical blade facing the same direction as the second helical blade 402*a*. Compared with the second helical blade 402*a*, the discharge blade 49 has a small pitch and a small perimeter (diameter) when viewed from one side along the second rotational axis Ax2. Thus, the discharge blade 49 rotates as the rotating shaft 402*b* rotates, and the developer passing over the restriction portion 46 and conveyed to the discharge chamber 457 is sent to the left in FIG. 4 and discharged from the discharge port 455 to the outside of the case 45.

The restriction portion 46 is disposed between the second conveyance chamber 452 and the discharge chamber 457. The restriction portion 46 holds back the developer conveyed downstream inside the second conveyance chamber 452 and allows the developer to be conveyed to the discharge port 455 (discharge chamber 457) when the amount becomes a predetermined level or above. Here, the restriction portion 46 includes the reverse screw 461. The reverse screw 461 rotates around the second rotational axis Ax2 together with the second stirring screw 402 to convey the developer in a direction opposite the direction of conveyance by the second stirring screw 402. That is, in the present embodiment, the reverse screw 461 provided for the rotating shaft 402*b* and disposed between the second conveyance chamber 452 and the discharge chamber 457 functions as the restriction portion 46. This configuration achieves the restriction portion 46 relatively easily.

As shown in FIG. 5, the reverse screw 461 is a helical blade provided for the rotating shaft 402*b* and runs in a direction opposite the direction of the second helical blade 402*a* (in reversed phase). Compared with the second helical blade 402*a*, the reverse screw 461 has a small pitch and a small perimeter (diameter) when viewed from one side along the second rotational axis Ax2. This creates a gap between the reverse screw 461 and the inner wall of the case 45. The developer is conveyed through the gap to the discharge port 455. It is noted that, compared with the discharge blade 49, the reverse screw 461 has a large perimeter (diameter) when viewed from one side along the second rotational axis Ax2.

The developing device 4 may further includes a toner density sensor. For example, the toner density sensor is disposed at a position facing the first stirring screw 401 inside the case 45. In the developing device 4, toner is supplied from a supply device into the case 45 through the supply port 456 depending on the toner density determined using the toner density sensor.

With the above-described configuration, the drive portion 47 drives the stirring screws 40 to rotate the first stirring screw 401 and the second stirring screw 402 and thereby stirs and conveys (circulates) the developer. That is, the stirring screws 40 convey the developer while stirring the developer using the first stirring screw 401 and the second stirring screw 402 to circulate the developer between the first conveyance chamber 451 and the second conveyance chamber 452 through the connection paths 453. Thus, the toner supplied from the toner container 316 into the case 45 circulates inside the case 45 while being stirred and mixed with the carrier inside the case 45.

When the toner is consumed in development, the developer including the carrier is supplied from the supply port 456 into the first conveyance chamber 451. In addition, as the rotating shaft 402*b* rotates with the driving of the stirring screws 40, the reverse screw 461 and the discharge blade 49 also rotate. In particular, as the reverse screw 461 rotates, the reverse screw 461 (restriction portion 46) applies a conveying force to the developer in a direction opposite the direction of conveyance by the second stirring screw 402. That is, the developer is subjected to a leftward (in FIG. 5) conveying force produced by the second helical blade 402*a* and subjected to a rightward (FIG. 5) conveying force produced by the reverse screw 461. This causes the developer to be held back by the restriction portion 46 to accumulate. The surplus of the developer then passes over the restriction portion 46 and is discharged to the outside of the case 45 through the discharge port 455.

As a result, in the developing device 4 adopting the trickle development method, the developer is supplied to and discharged from the case 45 as appropriate, and thereby the amount of the developer inside the case 45 is stabilized. It is noted that, in the image forming apparatus 10 including the developing device 4 adopting the trickle development method, the amount of the developer inside the case 45 may also vary depending on, for example, image formation conditions such as types of sheets (media) on which images are to be formed and the density of images to be formed, the amount (number of sheets) of image formation, and the like.

For example, the stirring speed of the stirring screws 40 varies depending on the types of sheets (media) on which images are to be formed. As an example, to maintain the fixing performance, images are formed on sheets such as thick paper and envelopes at a low speed compared with the speed when normal paper is used. In this manner, as the linear speed of the sheets (linear sheet speed) during image formation varies, the stirring speed of the stirring screws 40 also varies in conjunction with the linear speed. That is, when images are formed on sheets such as thick paper and envelopes, the linear speed is reduced, and thus the stirring speed of the stirring screws 40 is also reduced.

Figure 6:
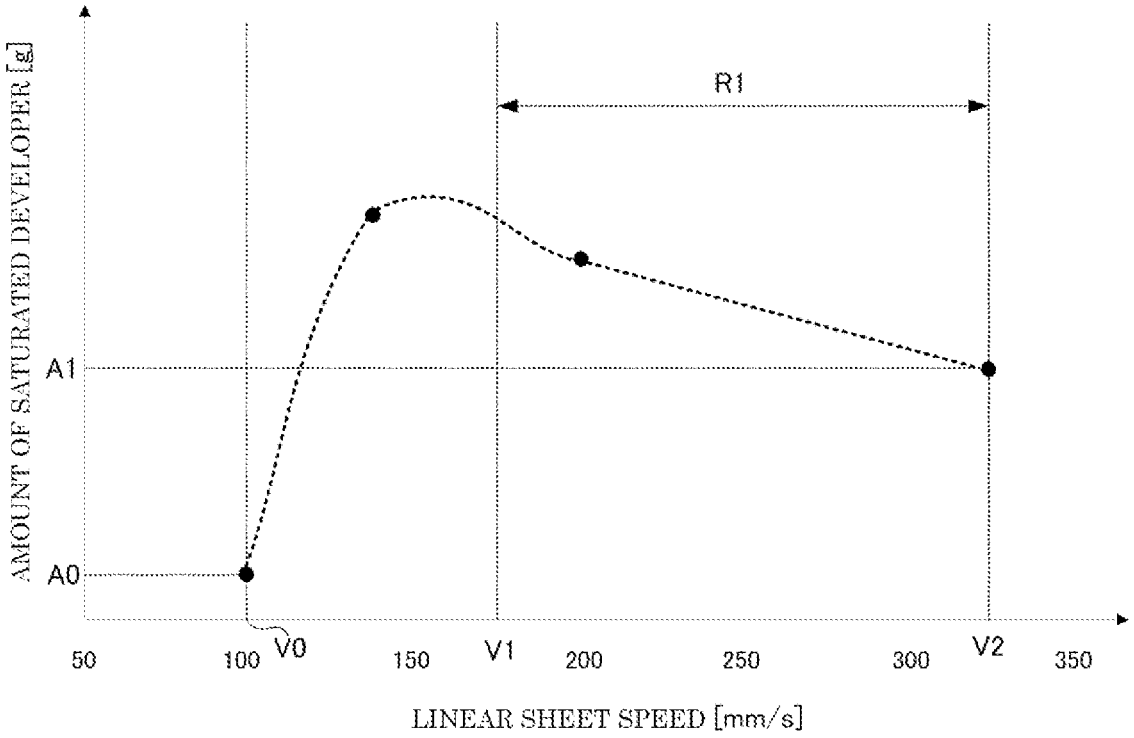
FIG. 6 illustrates an example relationship between a linear sheet speed and an amount of saturated developer in the developing device according to Embodiment 1.

Basically, as the stirring speed increases (with increasing linear speed), the bulk density of the developer inside the case 45 increases, and thus the developer is discharged from the case 45 more easily. Conversely, as the stirring speed decreases (with decreasing linear speed), the developer is discharged from the case 45 less easily. That is, as is clear from FIG. 6 showing the relationship between the linear speed of the sheets (linear sheet speed) during image formation and the amount of the developer inside the case 45 (amount of saturated developer), the amount of the developer basically tends to increase with decreasing linear speed. In FIG. 6, a linear sheet speed V1 indicates the linear speed during image formation on thick paper, and a linear sheet speed V2 indicates the linear speed during image formation on normal paper (V2>V1). That is, in the image forming apparatus 10, the linear sheet speed varies in a range R1 from V1 to V2. Thus, the amount of the saturated developer increases with decreasing linear speed in the range R1 of the linear sheet speed used for the image formation process. In general, settings for printing on normal paper are used as standards, and thus A1 is set as a standard for the amount of the saturated developer. Accordingly, when more images are formed on sheets such as thick paper, the amount of the developer inside the case 45 increases from A1 to an excessive level.

In addition, the toner supplied from the supply port 456 includes carrier. When images are formed with high density, the amount of the carrier supplied with the toner increases, resulting in an increase in the developer. Furthermore, as the image formation process is repeated, the carrier deteriorates, and the flowability of the developer decreases. This also causes an increase in the developer.

In the developing device 4 according to the present embodiment, the control portion 48 drives the stirring screws 40 during the discharge period such that the mean drive speed of the stirring screws 40 per unit time becomes less than that during the development process period to forcibly discharge the developer from the discharge port 455. Accordingly, the developing device 4 can adapt to an increase in the amount of the developer inside the case 45 caused by the image formation conditions such as the types of the sheets (media) on which images are to be formed and the density of images to be formed, the amount (number of sheets) of image formation, and the like as described above.

Specifically, the control portion 48 controls the rotational speed of the stirring screws 40 during the discharge period to be less than that during the development process period, thereby reducing the mean number of rotations of the stirring screws 40 per unit time to a level less than that during the development process period. As an example, the control portion 48 reduces the voltage or electric current applied to the drive portion 47 to a level less than that during the development process period. As a result, the number of rotations (rotational speed) of the drive portion 47 is reduced, and thus the rotational speed (number of rotations) of the stirring screws 40 is controlled to be low. This minimizes noise generated at the drive portion 47 compared with a case where, for example, the drive portion 47 is intermittently driven.

Here, assuming that the rotational speed, that is, the stirring speed of the stirring screws 40 is determined in conjunction with the linear sheet speed, it is preferable that the control portion 48 control the rotational speed of the stirring screws 40 to be as low as, for example, a linear sheet speed V0 in FIG. 6 during the discharge period. That is, during the discharge period, the control portion 48 drives the stirring screws 40 at a speed even less than the lower limit (V1) of the range R1 of the linear sheet speed used at least for the image formation process. When the stirring screws 40 are driven at an extremely low drive speed in this manner, the effect of restriction by the restriction portion 46 (reverse screw 461) decreases, and, as a result, the discharge of the developer over the restriction portion 46 is facilitated. As shown in FIG. 6, because the discharge of the developer is facilitated, the amount of the saturated developer at the linear sheet speed V0 is significantly low (A0) compared with the lower limit (A1) in the range R1 of the linear sheet speed used for the image formation process.

[4] Development Control Method

Figure 7:
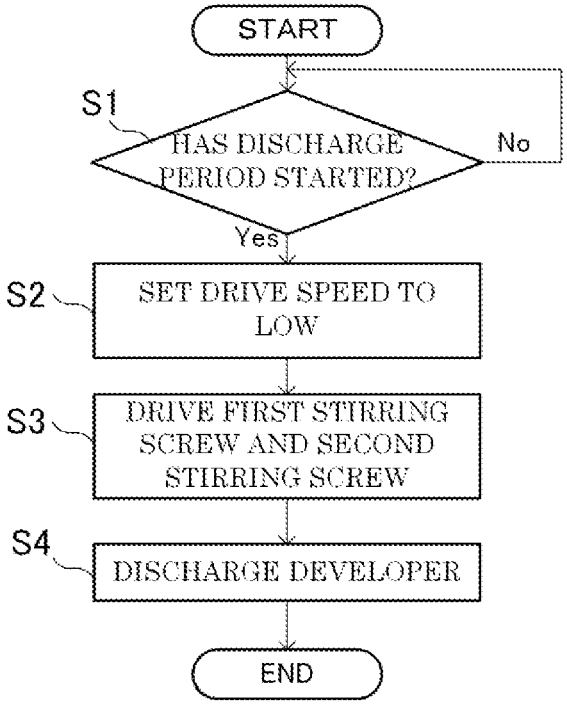
FIG. 7 is a flowchart of an example operation of the developing device according to Embodiment 1.

Next, a development control method, which is an operation of the control portion 48 of the developing device 4 according to the present embodiment, will be described with reference to FIG. 7. Here, steps S1, S2, . . . in FIG. 7 represent the numbers of processing procedures (steps) performed by the control portion 48.

<Step S1>

First, in step S1, the control portion 48 determines whether or not the discharge period has started. If a condition, serving as a trigger, is met, the control portion 48 determines that the discharge period has started (Yes in step S1), and moves the process to step S2. The condition is chosen from various options described below. If the condition is not met, the control portion 48 determines that the discharge period has not started (No in step S1), and repeats step S1.

<Step S2>

In step S2, the control portion 48 sets the drive speed of the stirring screws 40 to low. At this moment, the control portion 48 sets the drive speed of the stirring screws 40 to low compared with that during the development process period that contributes to at least the image formation process. As an example, the control portion 48 sets the rotational speed of the stirring screws 40 to a level as low as the linear sheet speed V0 in FIG. 6.

<Step S3>

In step S3, the control portion 48 drives the stirring screws 40 at the drive speed set in step S2. At this moment, the control portion 48 drives the first stirring screw 401 and the second stirring screw 402 at the same speed by outputting electrical signals to the drive portion 47.

<Step S4>

In step S4, the developer is discharged from the discharge port 455 as a result of driving the stirring screws 40 in step S3. A process of forcibly discharging the developer during a period (discharge period) other than the development process period in which the development process is performed for the image formation process as described above is also referred to as a "forced discharge process". The forced discharge process facilitates the discharge of the developer inside the case 45 and prevents an increase in the amount of the developer inside the case 45. Thus, the amount of the developer can be stabilized.

The procedure of the development control method described above is only an example, and the order of the processes shown in the flowchart in FIG. 7 may be changed as appropriate, or another process may be added.

Because the discharge period is a period for forcibly discharging the developer from the discharge port 455, it is preferable that the discharge period be defined using an event that is likely to cause an increase in the amount of the developer inside the case 45 as a trigger. That is, as described above, the amount of the developer inside the case 45 can increase depending on the image formation conditions such as the types of the sheets (media) on which images are to be formed and the density of images to be formed, the amount (number of sheets) of image formation, and the like. Accordingly, it is preferable that these conditions be set as triggers for the discharge period. Specifically, the following three modes may be applicable.

As a first mode, the discharge period is triggered at least by the image formation process using the developer executed at an image formation speed less than or equal to a threshold speed. Here, the threshold speed is set within the range R1 of the linear sheet speed from V1 to V2 in FIG. 6. As an example, the threshold speed may be an intermediate value between V1 and V2, a value less than the intermediate value, or a value close to V1. With this setting, for example, when the image formation process at a low speed (threshold speed or below) is performed on sheets such as thick paper and envelopes, the control portion 48 is triggered to determine that the discharge period has started and executes the above-described forced discharge process. Thus, the developing device 4 can prevent an increase in the amount of the developer caused by the low image formation speed. It is noted that the discharge period only needs to be "triggered" by the execution of the image formation process and does not necessarily start immediately after the execution of the image formation process. As an example, the discharge period may start when another condition is met (for example, after a certain time has elapsed or when a predetermined time has arrived) after the execution of the image formation process.

As a second mode, the discharge period is triggered at least by the image formation process using the developer executed on sheets of more than or equal to a threshold sheet count. Here, the threshold sheet count is set to, for example, hundreds, thousands, or tens of thousands. With this setting, for example, when the number of sheets on which the image forming apparatus 10 executes the image formation process reaches the threshold sheet count, the control portion 48 is triggered to determine that the discharge period has started and executes the above-described forced discharge process. Thus, the developing device 4 can prevent an increase in the amount of the developer caused by a reduction in the flowability of the developer deteriorated by the repetition of the image formation process. Here, after the execution of the image formation process, the control portion 48 may wait for a print job to be completed or pause the print job before executing the forced discharge process. In the latter case, the print job is resumed after the forced discharge process.

As a third mode, the discharge period is triggered at least by the image formation process, using the developer, in which images with a dot count of more than or equal to a dot count threshold are formed. Here, the dot count threshold is set based on, for example, the amount of the carrier supplied together with the toner. With this setting, for example, when the value of the dot count reaches the dot count threshold after the image forming apparatus 10 executes the image formation process with high density, the control portion 48 is triggered to determine that the discharge period has started and executes the above-described forced discharge process. Thus, the developing device 4 can prevent an increase in the amount of the developer caused by an increase in the supply rate of the carrier resulting from, for example, the image formation process with high density, i.e., at a high print rate (coverage rate). Here, after the execution of the image formation process, the control portion 48 may wait for a print job to be completed or pause the print job before executing the forced discharge process. In the latter case, the print job is resumed after the forced discharge process.

The above-described three modes may be adopted in combination. For example, the combination of the first and second modes can prevent both an increase in the amount of the developer caused by the low image formation speed and an increase in the amount of the developer caused by a reduction in the flowability of the developer deteriorated by the repetition of the image formation process. Furthermore, the threshold speed, the threshold sheet count, and the dot count threshold are not fixed values and may be set by, for example, users.

In addition, in the present embodiment, the three developing units 41 to 43 among the four developing units 41 to 44 share a single drive portion 47. The single drive portion 47 drives the stirring screws 40 of the three developing units 41 to 43. That is, the stirring screws 40 of the developing unit 44 of black (Bk) is driven by another drive portion 47 separately. Accordingly, during the above-described discharge period, the forced discharge process is executed in the three developing units 41 to 43 at the same time. It is noted that the configuration is not limited to this. For example, the four developing units 41 to 44 may be separately driven by respective drive portions 47, or two or four of the developing units 41 to 44 may share a single drive portion 47.

[5] Modification

The plurality of components included in the image forming apparatus 10 may be dispersedly provided for a plurality of housings. For example, the image reading portion 2 and the image forming portion 3 may be provided for different housings.

In addition, the restriction portion 46 may not necessarily include the reverse screw 461. That is, the restriction portion 46 only needs to be disposed between the stirring screws 40 and the discharge port 455 and to have the function of restricting the movement of the developer toward the discharge port 455 depending on the drive speed of the stirring screws 40. As an example, the restriction portion 46 may include a valve that opens and closes in conjunction with the drive speed of the stirring screws 40.

In addition, the control portion 48 only needs to drive the stirring screws 40 during the discharge period such that the mean drive speed of the stirring screws 40 per unit time is less than that during the development process period, and does not necessarily control the rotational speed of the stirring screws 40 to be less than that during the development process period. For example, the control portion 48 may intermittently drive the stirring screws 40 during the discharge period so that the mean drive speed of the stirring screws 40 per unit time is less than that during the development process period.

In addition, the configuration of the developing device 4 according to Embodiment 1 is not limited to the image forming apparatus 10 of the tandem type including a plurality of photoconductors (photoconductor drums) corresponding one-to-one with a plurality of colors, and may be applicable to a monochrome image forming apparatus.

Embodiment 2

The developing device 4 according to the present embodiment differs from the developing device 4 according to Embodiment 1 in the timing to execute the forced discharge process. In the description below, common reference numbers and symbols are used for components identical to those in Embodiment 1, and the detailed descriptions will be omitted.

In the present embodiment, the discharge period is set at any timing other than the development process period in which the development process using the developer is performed regardless of the operation of the image forming apparatus 10. As an example, the control portion 48 sets a predetermined time at which the development process is not expected to be performed (for example, at 24:00 every Saturday) as a starting point of the discharge period to execute the forced discharge process. As another example, the control portion 48 sets the starting points of the discharge period at regular or random intervals (for example, every 24 hours) to execute the forced discharge process.

In this manner, the amount of the developer inside the case 45 can also be stabilized in the case where the forced discharge process is performed at regular or irregular intervals. The configuration of Embodiment 2 may be applicable in combination with any configurations (including Modification) described in Embodiment 1.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a case storing developer;

a stirring screw configured to circulate the developer inside the case while stirring the developer;

a discharge port for discharging the developer from the case;

a restriction portion disposed between the stirring screw and the discharge port and configured to restrict movement of the developer toward the discharge port depending on a drive speed of the stirring screw; and a control portion configured to drive the stirring screw such that, during a discharge period other than a development process period in which a development process using the developer is performed, a mean drive speed of the stirring screw per unit time is less than the mean drive speed during the development process period to move the developer toward the discharge port through the restriction portion.

2. The developing device according to claim 1, wherein the case includes:

a first conveyance chamber and a second conveyance chamber disposed in parallel and extending in a predetermined direction; and connection paths located at both ends of the first conveyance chamber and the second conveyance chamber in the predetermined direction and connecting interior spaces of the first conveyance chamber and the second conveyance chamber, the stirring screw includes:

a first stirring screw configured to rotate around a first rotational axis parallel to the predetermined direction to convey the developer in the predetermined direction to a first side inside the first conveyance chamber while stirring the developer; and a second stirring screw configured to rotate around a second rotational axis parallel to the predetermined direction to convey the developer oppositely in the predetermined direction to a second side inside the second conveyance chamber while stirring the developer, the discharge port is located downstream of the second conveyance chamber in a direction along which the developer is conveyed, and the restriction portion includes a reverse screw configured to rotate around the second rotational axis together with the second stirring screw to convey the developer in a direction opposite a direction of conveyance by the second stirring screw.

3. The developing device according to claim 1, wherein the control portion controls a rotational speed of the stirring screw during the discharge period to be less than the rotational speed during the development process period, thereby reducing a mean number of rotations of the stirring screw per unit time to a level less than the mean number of rotations during the development process period.

4. The developing device according to claim 1, wherein the discharge period is triggered at least by an image formation process using the developer executed at an image formation speed of less than or equal to a threshold speed.

5. The developing device according to claim 1, wherein the discharge period is triggered at least by an image formation process using the developer executed on sheets of more than or equal to a threshold sheet count.

6. The developing device according to claim 1, wherein the discharge period is triggered at least by an image formation process, using the developer, in which an image with a dot count of more than or equal to a dot count threshold is formed.

7. An image forming apparatus comprising:

the developing device according to claim 1; and an image forming portion configured to form an image using the developer.

8. A development control method used by a developing device, the developing device comprising:

a case storing developer;

a stirring screw configured to circulate the developer inside the case while stirring the developer;

a discharge port for discharging the developer from the case; and a restriction portion disposed between the stirring screw and the discharge port and configured to restrict movement of the developer toward the discharge port depending on a drive speed of the stirring screw, the development control method comprising:

driving the stirring screw such that, during a discharge period other than a development process period in which a development process using the developer is performed, a mean drive speed of the stirring screw per unit time is less than the mean drive speed during the development process period to move the developer toward the discharge port through the restriction portion.

* * * * *